US009831561B2

(12) United States Patent
Byun et al.

(10) Patent No.: US 9,831,561 B2
(45) Date of Patent: Nov. 28, 2017

(54) REFLECTIVE ANTENNA APPARATUS AND DESIGN METHOD THEREOF

(71) Applicant: ELECTRONICS AND TELECOMMUNICATIONS RESEARCH INSTITUTE, Daejeon (KR)

(72) Inventors: Woo Jin Byun, Daejeon (KR); Yong Heui Cho, Daejeon (KR); Young Seung Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 42 days.

(21) Appl. No.: 15/135,709

(22) Filed: Apr. 22, 2016

(65) Prior Publication Data

US 2016/0315395 A1 Oct. 27, 2016

(30) Foreign Application Priority Data

Apr. 24, 2015 (KR) ..... 10-2015-0057882
Feb. 29, 2016 (KR) ..... 10-2016-0024355

(51) Int. Cl.
*H01Q 19/10* (2006.01)
*H01Q 19/18* (2006.01)
(Continued)

(52) U.S. Cl.
CPC ..... *H01Q 15/148* (2013.01); *H01Q 19/185* (2013.01); *H01Q 19/19* (2013.01)

(58) Field of Classification Search
CPC .... H01Q 15/148; H01Q 15/16; H01Q 15/167; H01Q 19/10; H01Q 19/18; H01Q 19/185; H01Q 19/19
See application file for complete search history.

(56) References Cited

U.S. PATENT DOCUMENTS

2006/0119532 A1 6/2006 Yun et al.
2011/0241956 A1 10/2011 Byun et al.
2014/0333503 A1 11/2014 Byun et al.

FOREIGN PATENT DOCUMENTS

GB WO2005069443 * 7/2005 ..... H01Q 15/16
WO 2005/069443 7/2005

OTHER PUBLICATIONS

Fabrizio Tamburini et al., "Encoding many channels in the same frequency through radio vorticity: first experimental test", Radio vorticity channels: transmission tests, pp. 1-17.

* cited by examiner

*Primary Examiner* — Hoang Nguyen
(74) *Attorney, Agent, or Firm* — Kile Park Reed & Houtteman PLLC

(57) ABSTRACT

A reflective antenna apparatus according to an exemplary embodiment of the present invention includes a feeder which receives an electromagnetic wave from a transmitter and distributes the electromagnetic wave to the antenna apparatus; a sub reflector which has a step formed to generate an orbital angular momentum (OAM) mode electromagnetic wave; and a main reflector which has a step formed to generate the same electromagnetic wave as the OAM mode generated by the sub reflector and cancels the OAM mode electromagnetic wave generated by the sub reflector and an OAM mode electromagnetic wave generated by the main reflector to radiate the electromagnetic waves to a far field.

20 Claims, 8 Drawing Sheets

(51) Int. Cl.

| | |
|---|---|
| ***H01Q 15/14*** | (2006.01) |
| ***H01Q 19/185*** | (2006.01) |
| ***H01Q 19/19*** | (2006.01) |

REFLECTIVE ANTENNA APPARATUS AND DESIGN METHOD THEREOF

CROSS-REFERENCE TO RELATED APPLICATIONS

This application claims priority to and the benefit of Korean Patent Application No. 10-2015-0057882, filed in the Korean Intellectual Property Office on Apr. 24, 2015, Korean Patent Application No. 10-2016-0024355, filed in the Korean Intellectual Property Office on Feb. 29, 2016 the entire contents of which are incorporated herein by reference.

TECHNICAL FIELD

The present invention relates to a reflective antenna apparatus and a design method thereof, and more particularly, to a reflector or reflectarray antenna technology having a low focal length to diameter (f/D) ratio.

BACKGROUND ART

A reflector or a reflectarray antenna which is used in a super high frequency band is frequently applied to a large size and high gain antenna design. A reflector or a reflectarray substrate which forms a large size antenna is used as a main reflector to strongly focus an electromagnetic wave radiated from an axial feeder forwardly to obtain a high gain characteristic.

In this case, since an interval between the main reflector and the axial feeder needs to be long as much as the focal length, when an antenna is provided, a space which is occupied by the antenna is increased in order to secure the focal length. Therefore, in order to reduce the space (antenna profile) occupied by the antenna, the f/D ratio (the focal length to diameter ratio) needs to be lowered.

However, when the interval between the main reflector and the axial feeder is narrowed to lower the f/D ratio, an unnecessary electromagnetic wave which is flowed into the feeder is increased, so that reflection characteristics of the feeder undesirably deteriorate.

SUMMARY OF THE INVENTION

An exemplary embodiment of the present invention has been made in an effort to provide a reflective antenna apparatus having a low f/D ratio and an excellent reflection characteristic by modifying structures of a main reflector and a sub reflector to maximize an electromagnetic wave which is forwardly radiated through the main reflector while minimizing an electromagnetic wave which is reflected by the sub reflector and unnecessarily flowed into a feeder and a design method thereof.

Specifically, the exemplary embodiment of the present invention provides a reflective antenna apparatus in which steps are formed on a main reflector and a sub reflector to generate an OAM mode and a design method thereof.

The exemplary embodiment of the present invention provides a reflective antenna apparatus in which reflectarray substrates are formed on a main reflector and a sub reflector to generate an OAM mode and a design method thereof.

Technical objects of the present invention are not limited to the aforementioned technical objects and other technical objects which are not mentioned will be apparently appreciated by those skilled in the art from the following description.

An exemplary embodiment of the present invention provides a reflective antenna apparatus including: a feeder which receives an electromagnetic wave from a transmitter and distributes the electromagnetic wave to the antenna apparatus; a sub reflector which has a step formed to generate an orbital angular momentum (OAM) mode electromagnetic wave; and a main reflector which has a step formed to generate the same electromagnetic wave as the OAM mode generated by the sub reflector and cancels the OAM mode electromagnetic wave generated by the sub reflector and an OAM mode electromagnetic wave generated by the main reflector to radiate the electromagnetic waves to a far field.

In the main reflector, the step may be formed between a highest portion and a lowest portion of a plate.

In the sub reflector, the step may be formed between a highest portion and a lowest portion of a plate.

The main reflector may have a plurality of steps and the sub reflector may have a plurality of steps.

The sub reflector may be configured by at least one of a Cassegrain shape, a Gregorian shape, and an axially displaced ellipse (ADE) shape.

The main reflector may determine a characteristic of the reflected OAM mode by the number of steps.

Another exemplary embodiment of the present invention provides a reflective antenna apparatus including: a feeder which receives an electromagnetic wave from a transmitter and distributes the electromagnetic wave to the antenna apparatus; a sub reflector in which a reflectarray substrate is formed to generate an orbital angular momentum (OAM) mode electromagnetic wave; and a main reflector in which a reflectarray substrate is formed to generate the same electromagnetic wave as the OAM mode generated by the sub reflector and which cancels the OAM mode electromagnetic wave generated by the sub reflector and an OAM mode electromagnetic wave generated by the main reflector to radiate the electromagnetic waves to a far field.

The reflectarray substrate may be configured based on a predetermined array of resonators which change a phase of a reflective wave.

Another exemplary embodiment of the present invention provides a reflective antenna apparatus including: a feeder which receives an electromagnetic wave from a transmitter and distributes the electromagnetic wave to the antenna apparatus; a sub reflector in which a reflectarray substrate is formed to generate an orbital angular momentum (OAM) mode electromagnetic wave; and a main reflector which has a step formed to generate the same electromagnetic wave as the OAM mode generated by the sub reflector and cancels the OAM mode electromagnetic wave generated by the sub reflector and an OAM mode electromagnetic wave generated by the main reflector to radiate the electromagnetic waves to a far field.

In the main reflector, the step may be formed between a highest portion and a lowest portion of a plate.

The main reflector may have a plurality of steps.

The main reflector may determine a characteristic of the reflected OAM mode by the number of steps.

Another exemplary embodiment of the present invention provides a reflective antenna apparatus including: a feeder which receives an electromagnetic wave from a transmitter and distributes the electromagnetic wave to the antenna apparatus; a sub reflector which has a step formed to generate an orbital angular momentum (OAM) mode electromagnetic wave; and a main reflector in which a reflectarray substrate is formed to generate the same electromagnetic wave as the OAM mode generated by the sub reflector and which cancels the OAM mode electromagnetic wave generated by the sub reflector and an OAM mode electromagnetic wave generated by the main reflector to radiate the electromagnetic waves to a far field.

The sub reflector may have a plurality of steps.

The sub reflector may be configured by at least one of a Cassegrain shape, a Gregorian shape, and an axially displaced ellipse (ADE) shape.

An exemplary embodiment of the present invention provides an antenna design method, including: reflecting an electromagnetic wave which is radiated from a sub reflector which generates a first OAM mode to a feeder; reflecting the reflective wave reflected from the sub reflector, by a main reflector which generates a second OAM mode, to output a final reflective wave in which the first OAM mode of the sub reflector and the second OAM mode of the main reflector are cancelled; and confirming a main beam characteristic of the final reflective wave.

The method may further include forming the sub reflector and the main reflector to change the first OAM mode and the second OAM mode when the main beam characteristic satisfies a predetermined value and confirming the main beam characteristic of the final reflective wave again.

When the first OAM mode and the second OAM mode are the same, the main beam characteristic may have a high gain characteristic.

An OAM mode of the final reflective wave may be obtained by subtracting the second OAM mode from the first OAM mode.

An antenna apparatus according to the present invention modifies structures of the main reflector and a sub reflector to improve a reflection characteristic which deteriorates as an interval between a feeder and the sub reflector is narrowed while reducing a f/D ratio, thereby providing a high gain characteristic.

Figure 1:
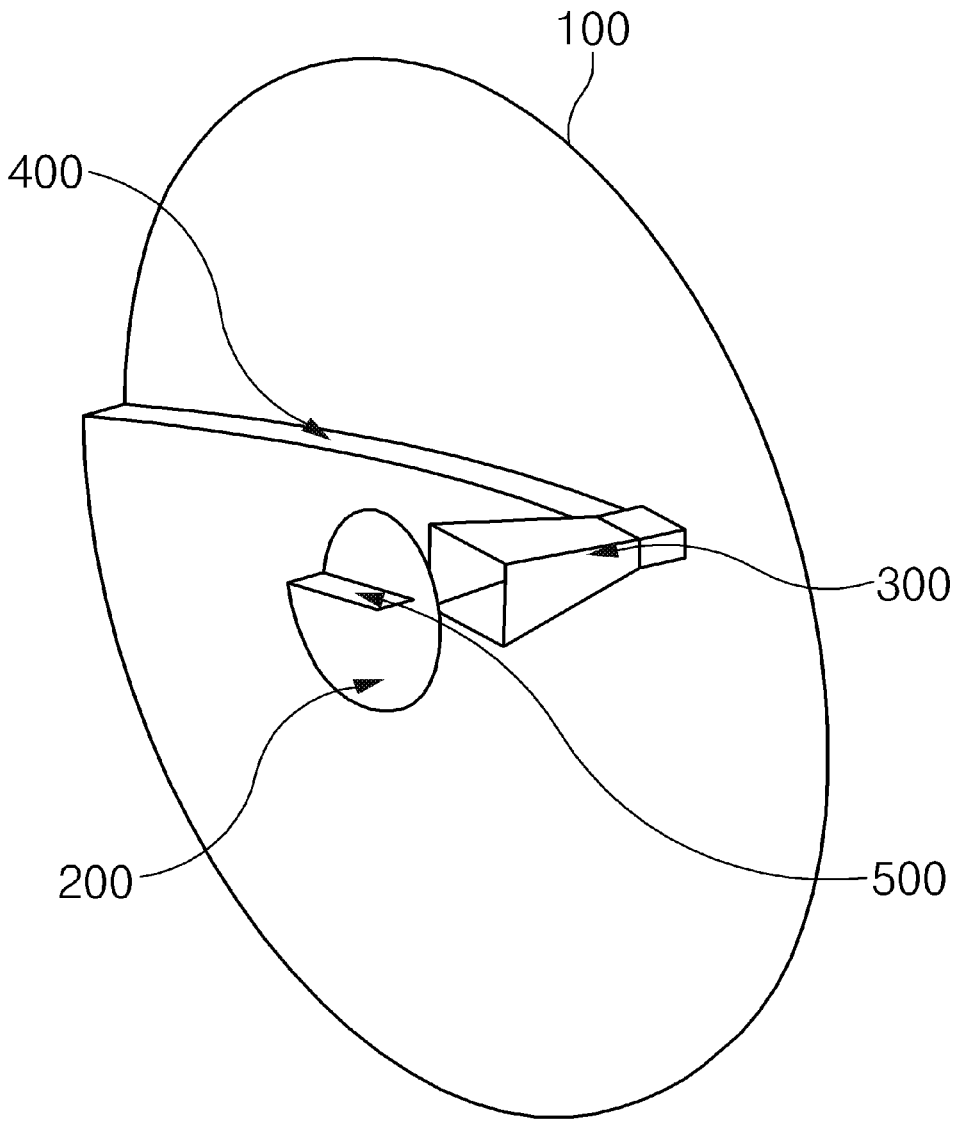
FIG. 1 is a configuration diagram of a reflective antenna apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, some embodiments of the present invention will be described in detail with reference to the accompanying drawings. When reference numerals denote components in the drawings, even though the like components are illustrated in different drawings, it should be noted that like reference numerals refer to the same components so much as possible. In describing the embodiments of the present invention, when it is determined that the detailed description of the known configuration or function related to the present invention may obscure the understanding of embodiments of the present invention, the detailed description thereof will be omitted.

In describing components of the exemplary embodiment of the present invention, terminologies such as first, second, A, B, (a), (b), and the like may be used. However, such terminologies are used only to distinguish a component from another component but nature, a sequence or an order of the component is not limited by the terminologies. If it is not contrarily defined, all terminologies used herein including technological or scientific terms have the same meanings as those generally understood by a person with ordinary skill in the art. Terminologies which are defined in a generally used dictionary should be interpreted to have the same meaning as the meaning in the context of the related art but are not interpreted as ideal or excessively formal meaning if they are not clearly defined in the present invention.

The present invention relates to a reflector or reflectarray antenna having a low focal length to diameter ratio and discloses a reflective antenna apparatus which lowers the focal length to diameter ratio between a main reflector and a feeder to achieve an excellent reflection characteristic and a high gain characteristic while minimizing a space occupied thereby.

Hereinafter, exemplary embodiments of the present invention will be specifically described with reference to FIGS. 1 to 6.

FIG. 1 is a configuration diagram of a reflective antenna apparatus according to an exemplary embodiment of the present invention.

A reflective antenna apparatus according to an exemplary embodiment of the present invention includes a main reflector 100, a sub reflector 200, and a feeder 300 provided between the main reflector 100 and the sub reflector 200.

The main reflector 100 is formed to have a metal plate structure, the feeder 300 is formed above a surface of the main reflector 100 to have a predetermined column shape, and the sub reflector 200 having a metal plate structure is provided above the feeder 300. Here, the main reflector 100 has a larger area than the sub reflector 200. Here, the plate refers to a surface which reflects an electromagnetic wave from a reflector such as the main reflector or the sub reflector of the antenna to the outside.

The feeder 300 receives the electromagnetic wave from a transmitter (not illustrated) to distribute the electromagnetic wave to the antenna apparatus. The feeder 300 in the present invention may be implemented to be the same as the feeder which is used for a general reflective antenna.

The main reflector 100 strongly focuses the electromagnetic wave radiated from the axial feeder 300 forwardly to have a high gain characteristic.

Steps 400 and 500 are formed on the main reflector 100 and the sub reflector 200, so that the metal plate generates an orbital angular momentum (hereinafter, referred to as an OAM) mode. The OAM mode is a technique which transmits or receives the electromagnetic wave using an electromagnetic wave mode and a communication method which distinguishes communication signals using a mathematical orthogonality of the OAM mode even though frequency, polarization, multiple antenna arrangement properties are equal. In this case, the electromagnetic wave modes are orthogonal to each other and independently transmit an electromagnetic wave power. Therefore, when the OAM technique is applied to wireless communication, independent communication channels which have different OAM modes and are distinguishable may be configured.

The main reflector 100 is formed to be different from a general main reflector plate such that a depth of the main reflector 100 is continuously changed in a $\phi$ direction of a spherical coordinate system so that a step 400 is formed between a highest part and a lowest part. A characteristic of the reflected OAM mode is determined by the depth change of the main reflector 100 generated in this case and a step 400.

The sub reflector 200 is supported by the feeder 300 to be formed on the main reflector 100 to be spaced apart therefrom. The sub reflector 200 is formed to be different from a general sub reflector plate such that a depth of the sub reflector 200 is continuously changed in a $\phi$ direction of a spherical coordinate system so that a step 500 is formed between a highest part and a lowest part. By doing this, the electromagnetic wave radiated from the feeder 300 is fully reflected from the sub reflector 200 to be reflected as an electromagnetic wave having a specific OAM mode number which is not 0, by the step 500 of the sub reflector.

In the OAM mode whose mode number is not 0, an electromagnetic wave amplitude in a propagation direction is 0, so that the electromagnetic wave power which is flowed into the feeder 300 is very small. Therefore, even though the f/D ratio is low, the reflection characteristic in view of feeder 300 may be improved.

The electromagnetic wave having a specific OAM mode which is reflected by the sub reflector 200 is reflected from the main reflector 100 again and an electromagnetic wave to which a specific OAM mode number is added by the step 400 of the main reflector 100 is strongly radiated to the front of the reflective antenna.

That is, when the OAM mode number/of the electromagnetic wave is not 0, a phase ($\phi$ of the spherical coordinate system) of a longitudinal section of the electromagnetic wave is constantly changed with respect to the propagation direction (($\theta$=0) of the spherical coordinate system) to be multiples of 360 degrees. In this case, the amplitude of the electromagnetic wave in the propagation direction ($\theta$=0) is 0, and a maximum point of the amplitude of the electromagnetic wave is located at an angle ($\theta \neq 0$) which is slightly displaced in the propagation direction.

If the OAM mode number is 0, the phase of the longitudinal section of the electromagnetic wave is constant in the propagation direction ($\theta$=0), so that the electromagnetic wave has a general electromagnetic wave radiation characteristic. The OAM mode number ($l_{tot}$) which is forwardly radiated by the antenna of FIG. 1 is determined by the following Equation 1.

$$l_{tot}=l_{main}-l_{sub} \qquad \text{Equation 1}$$

Here, $l_{main}$ is an OAM mode number which is made by the main reflector 100, $l_{sub}$ is an OAM mode number which is made by the sub reflector 200, and $l_{tot}$ is an OAM mode number of the overall electromagnetic wave which is radiated by the reflector antenna of FIG. 1. When $l_{sub}=l_{main}$, $l_{tot}$ is 0, so that an electromagnetic wave radiation characteristic having a general high gain characteristic is obtained.

In contrast, when the characteristic of the step 500 of the sub reflector 200 is reversed to set to be $l_{sub}=-l_{main}$, $l_{tot}=2l_{main}$, so as to be used for antenna design for OAM communication equipment which needs to generate an efficient high degree OAM mode.

Equation 1 may be applied to all main reflector and sub reflector structures of the related art. For example, a sub reflector plate, such as a Cassegrain shape using a hyperboloid surface, a Gregorian shape using an ellipse surface, or an axially displaced ellipse shape using an axially separated ellipse, is modified to generate a high degree OAM mode $l_{sub}$, and the main reflector is modified to reflect the OAM mode number which is the same as $l_{sub}$, to be applied to generate an electromagnetic wave having a high gain characteristic. That is, when Equation 1 is used, even though general main reflector and sub reflector structures are modified, so that even though a f/D ratio is low, a large size antenna having an excellent reflection characteristic of the feeder may be designed.

As described above, the reflective antenna apparatus according to an exemplary embodiment of the present invention uses the step 400 of the main reflector 100 and the sub reflector 200 to achieve an excellent reflection characteristic and a high gain characteristic.

Figure 2A:
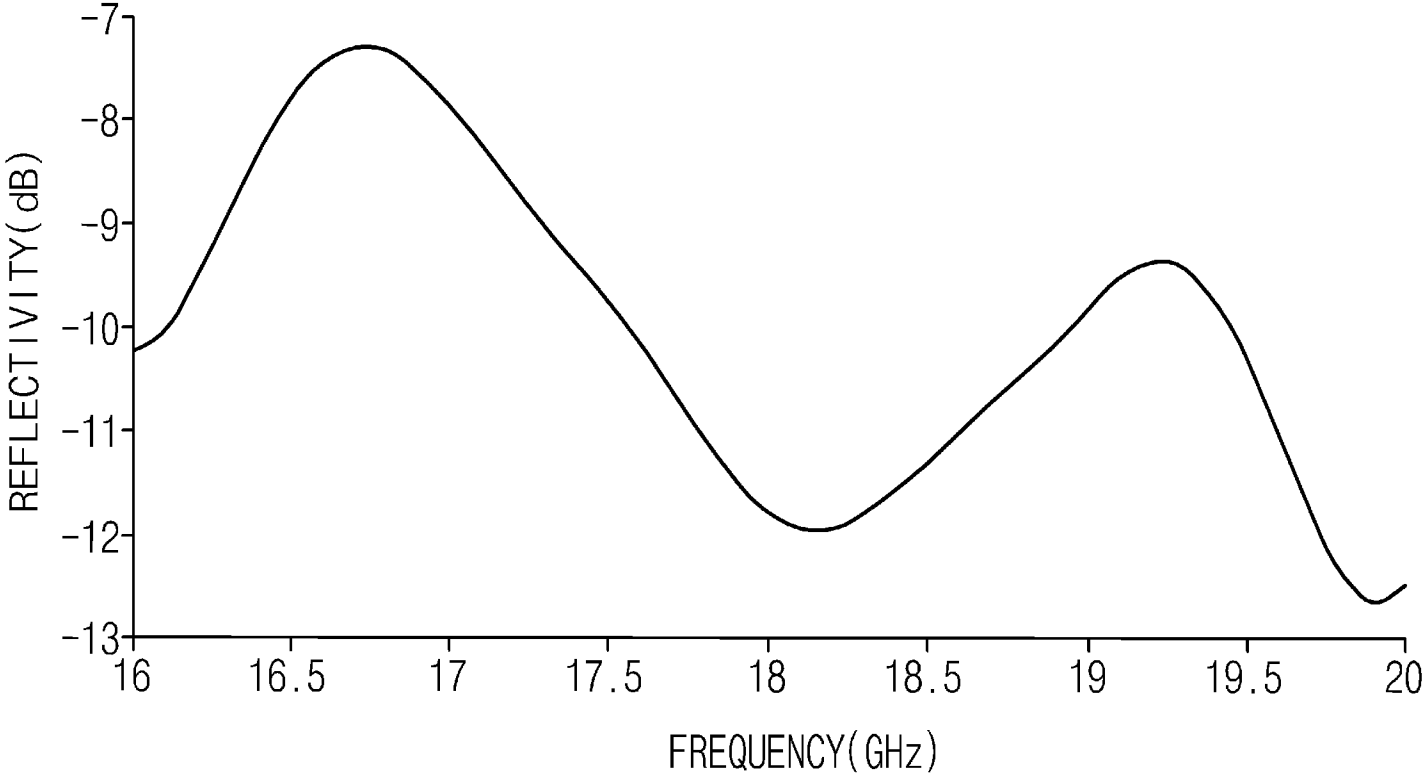
FIG. 2A is a graph illustrating a reflectivity characteristic of a Cassegrain reflector antenna having a high focal length to diameter ratio.

FIG. 2A is a graph illustrating a reflection characteristic of a general Cassegrain reflector antenna having a high focal length to diameter ratio.

That is, FIG. 2A illustrates a reflection characteristic of a feeder of a general Cassegrain reflector antenna whose f/D ratio is 0.3. As seen from the graph of FIG. 2A, it is understood that the reflection deteriorates near frequencies of 17 GHz and 19 GHz.

Figure 2B:
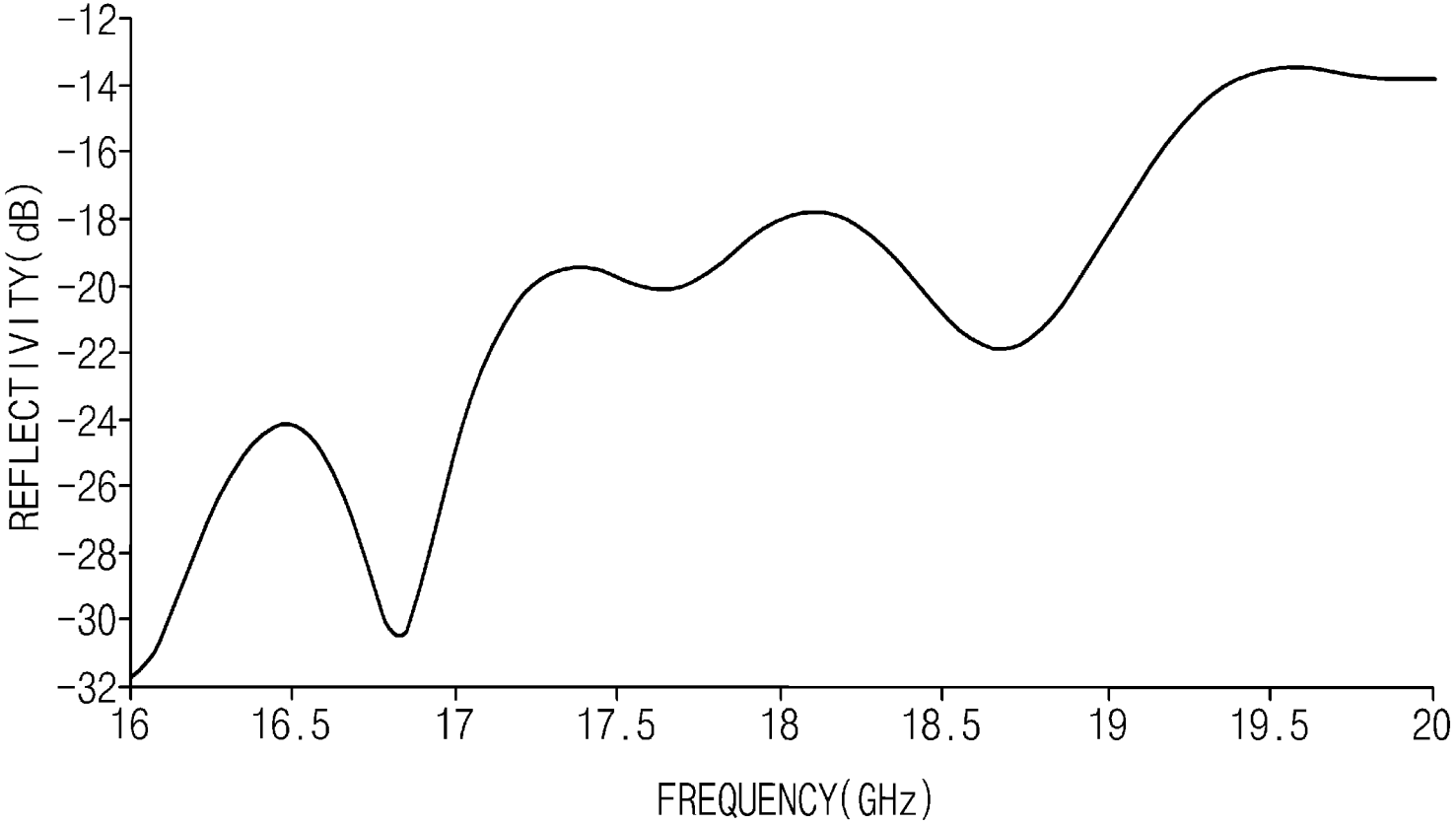
FIG. 2B is a graph illustrating a reflection characteristic of a reflective antenna apparatus having a low focal length to diameter ratio according to an exemplary embodiment of the present invention.

FIG. 2B is a graph illustrating a reflection characteristic of a reflective antenna apparatus having a low focal length to diameter ratio according to an exemplary embodiment of the present invention.

FIG. 2B illustrates a reflection characteristic when a step is provided to the main reflector and the sub reflector of the Cassegrain reflector antenna whose f/D ratio is 0.3 to generate $l_{main}$=1 and $l_{sub}$=1. Referring to FIG. 2B, it is understood that the reflection characteristic of the OAM mode cancellation reflector antenna according to an exemplary embodiment of FIG. 1 is very good at all frequency bands between frequencies 16 GHz and 20 GHz.

Figure 3A:
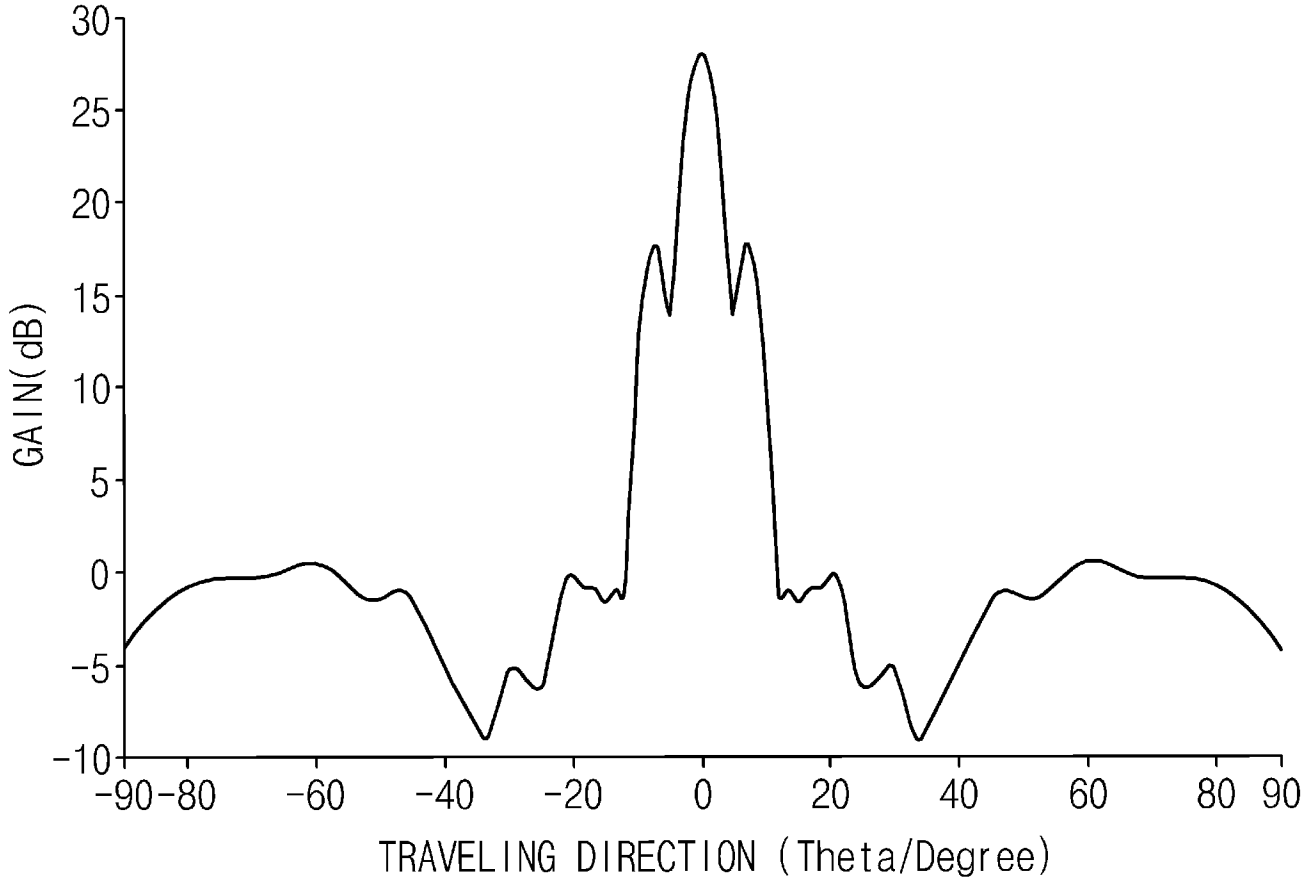
FIG. 3A is a graph illustrating a gain characteristic of a Cassegrain reflector antenna having a high focal length to diameter ratio.
Figure 3B:
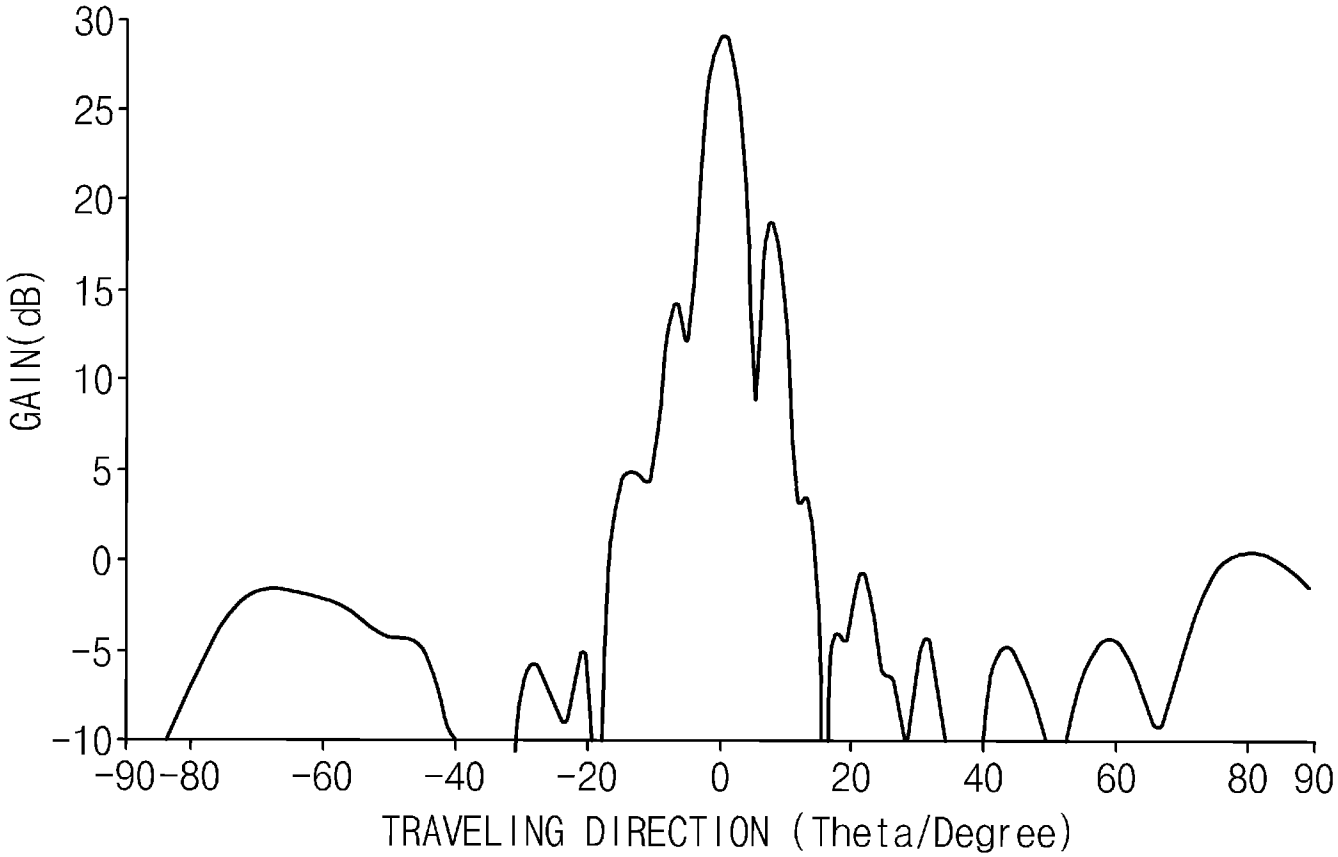
FIG. 3B is a graph illustrating a gain characteristic of a reflective antenna apparatus having a low focal length to diameter ratio according to an exemplary embodiment of the present invention.

FIG. 3A is a graph illustrating a gain characteristic of a general Cassegrain reflector antenna having a low focal length to diameter ratio. FIG. 3B is a graph illustrating a gain characteristic of a reflective antenna apparatus having a low focal length to diameter ratio according to an exemplary embodiment of the present invention.

FIGS. 3A and 3B both illustrate a gain characteristic of an antenna with respect to a f/D ratio of 0.3 and a frequency band of 17 GHz. When graphs of FIGS. 3A and 3B are compared, it is understood that a gain of an OAM mode cancellation reflective antenna apparatus according to an exemplary embodiment of the present invention of FIG. 3B is larger than that of FIG. 3A.

Figure 4:
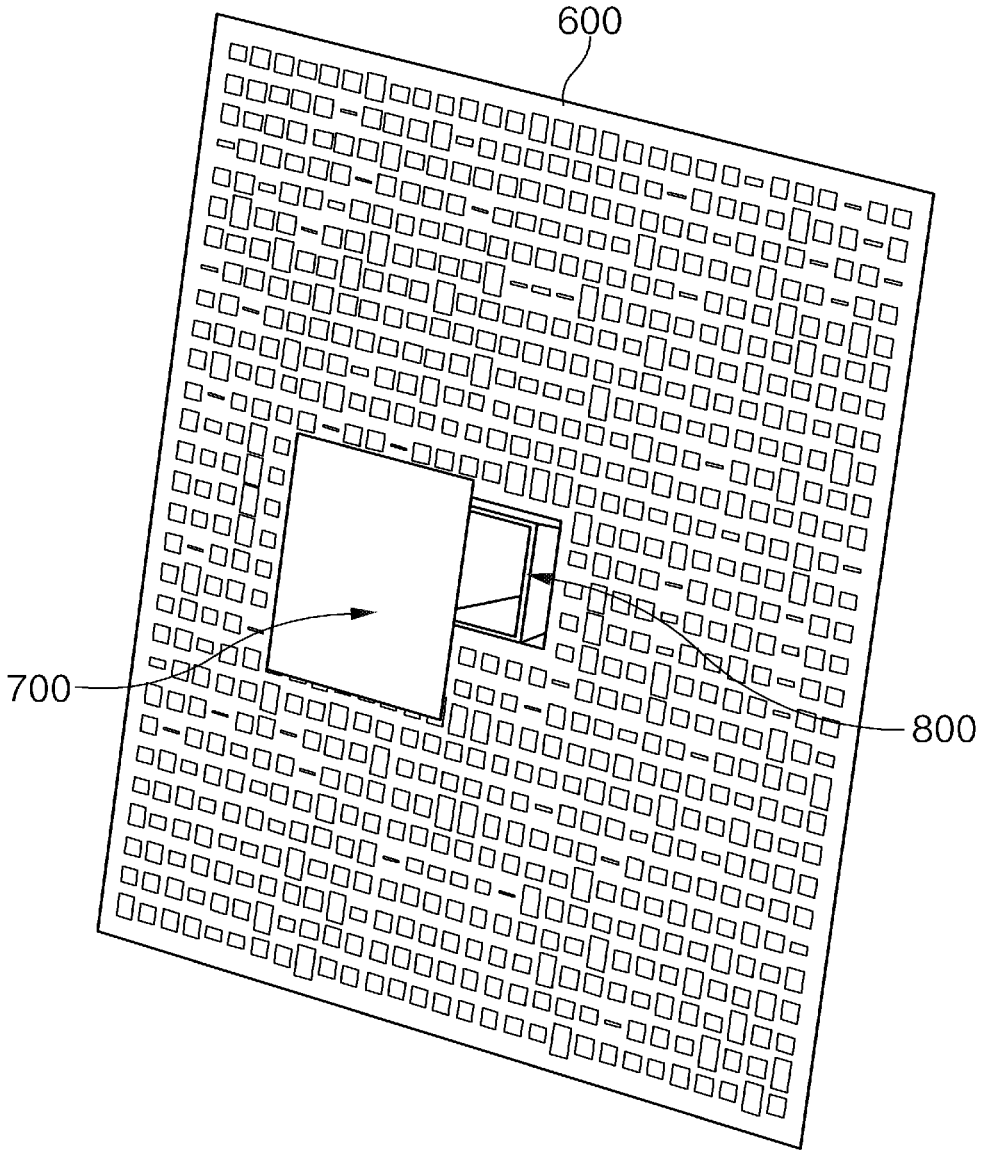
FIG. 4 is a configuration diagram of a reflective antenna apparatus according to another exemplary embodiment of the present invention.

FIG. 4 is a configuration diagram of a reflective antenna apparatus according to another exemplary embodiment of the present invention. That is, FIG. 4 illustrates a structure of an antenna apparatus using a reflectarray, instead of a reflector.

Referring to FIG. 4, an OAM mode cancellation reflectarray antenna according to the exemplary embodiment includes a main reflector 600, a sub reflector 700, and a feeder 800.

The main reflector 600 and the sub reflector 700 are formed to have a quadrangular array plate structure in which reflectors are arranged. However, the main reflector 600 is not limited to the quadrangle but may be implemented by various reflector array shapes. The main reflector 600 and the sub reflector 700 are configured by a microstrip patch based reflectarray so that they are easily manufactured and have a planar characteristic.

The feeder 800 is formed above the main reflector 600 and the sub reflector 700 is formed above the feeder 800 so that the main reflector 600 and the sub reflector 700 are spaced apart from each other with a predetermined distance.

Even though a horn antenna is assumed as the feeder 800, all various feed antennas used for the reflective antenna may be used therefor. For example, when a microstrip patch antenna with a coaxial line feeding is used instead of the horn antenna, a reflective antenna having a low f/D ratio in which a space occupied by the antenna is significantly reduced and which is approximately planar may be efficiently manufactured.

In FIG. 4, even though an example in which both the main reflector 600 and the sub reflector 700 are formed to have a reflectarray substrate structure is disclosed, when the main reflector 600 is formed to have a reflectarray substrate structure and the sub reflector 700 is formed to have a structure having a step, the same effect as the structure of FIGS. 1 and 4 may be deduced. In this case, the reflectarray substrate may be formed based on a predetermined array of resonators which change a phase of a reflective wave.

In contrast, when the main reflector 600 is formed to have a structure having a step and the sub reflector 700 is formed to have a reflectarray substrate structure, the same effect as the structure of FIGS. 1 and 4 may be similarly deduced.

In this case, in the present invention, even though as an example of modified reflector surfaces of the main reflector 600 and the sub reflector 700, an example of forming steps is disclosed, various types of reflector surface modification which may lower the f/D ratio are available.

According to all the exemplary embodiments, the main reflector and the sub reflector generate the same OAM mode to cancel the OAM modes, so that the influence of the electromagnetic wave which is applied to the feeder is minimized, thereby improving the reflection characteristic of the feeder.

As described above, the antenna apparatus according to the exemplary embodiment which generates an OAM mode electromagnetic wave uses the design of the main reflector, the sub reflector, and the feeder of the related art as it is and generates the same OAM modes through the modification of surfaces of the main reflector and the sub reflector to cancel the OAM modes, so that a large size antenna having an excellent reflection characteristic of the feeder may be simply manufactured. Therefore, considerable convenience is provided to an antenna designer.

The specification discloses a reflective antenna apparatus in which a reflection characteristic of the feeder is excellent even at a low f/D ratio because surfaces of the main reflector and the sub reflector are processed to generate the same OAM modes to be cancelled by each other. The antenna apparatus has a good reflection characteristic of the feeder even under a condition where f/D ratio is low to provide considerable convenience in designing a planar antenna in which an antenna gain is high and a space occupied by the antenna is very small.

Hereinafter, an antenna design method for adjusting a desired antenna main beam characteristic using OAM mode cancellation according to an exemplary embodiment of the present invention will be described in detail with reference to FIG. 5.

First, an electromagnetic wave radiated from a feeder 300 is primarily reflected from a sub reflector 200. In this case, when the sub reflector 200 generates a first OAM mode $l_{sub}$, the sub reflector 200 generates and reflects an OAM mode having a mode number of the first OAM mode $l_{sub}$ in step S101.

Thereafter, when the main reflector 100 generates a second OAM mode $l_{main}$, the reflective wave reflected in step S101 adds the second OAM mode $l_{main}$ to configure a secondary reflective wave.

The electromagnetic wave which travels the feeder 300, the sub reflector 200, and the main reflector 100 has an OAM mode cancellation characteristic represented in Equation 1 in step S103. That is, this is because the sub reflector 200 and the main reflector 100 reflect specific OAM modes, respectively, so that OAM modes of a final reflective wave are cancelled.

Figure 6:
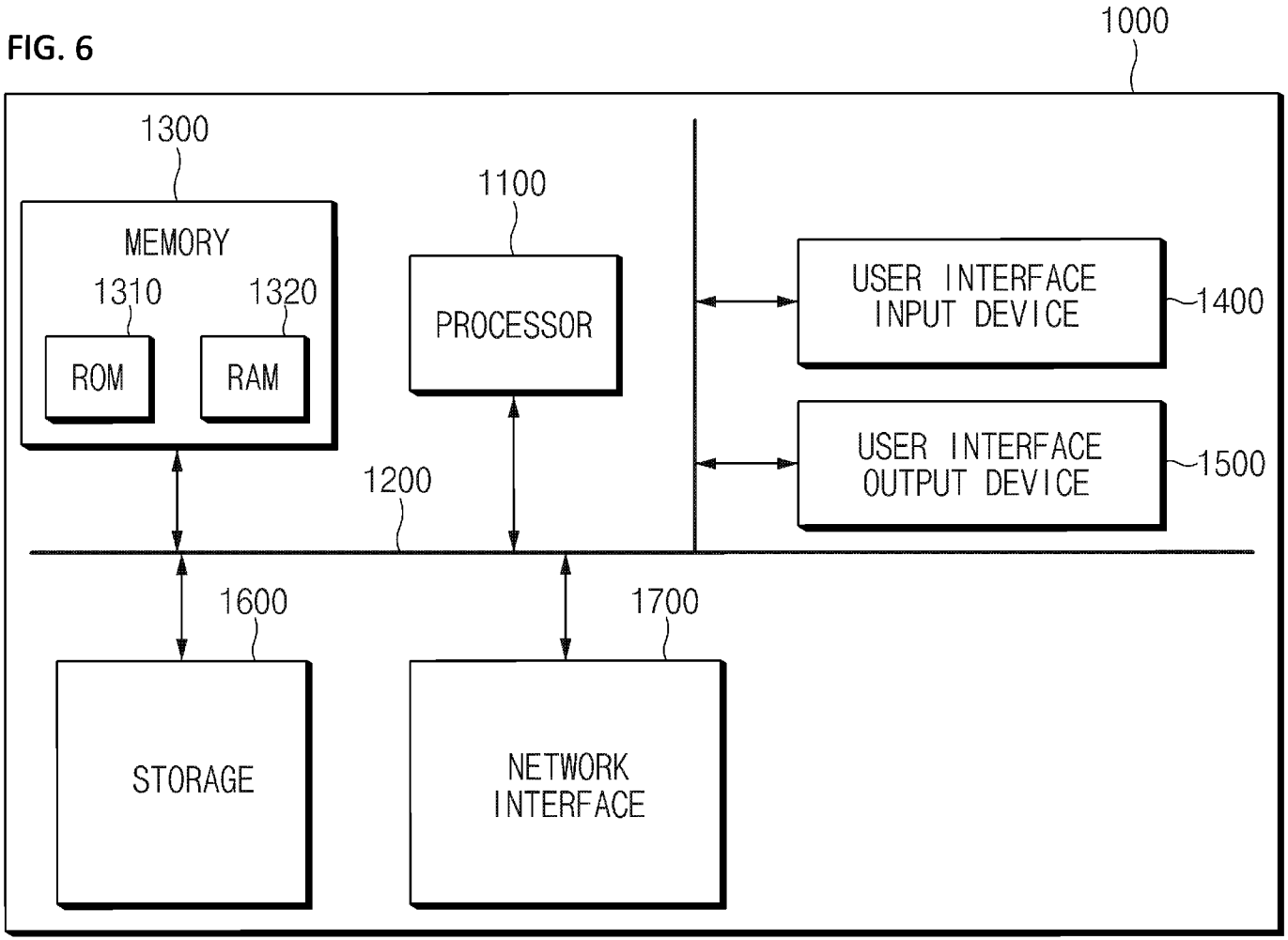
FIG. 6 is a configuration diagram of a computer system to which an antenna design technology according to an exemplary embodiment of the present invention is applied.

Next, a main beam characteristic of the final reflective wave is checked in a processor 1100 of a computer system of FIG. 6 in step S104 and when a desired main beam characteristic is not obtained, sequences are repeated from step S101.

In contrast, when the desired main beam characteristic is obtained from the final reflective wave, the processor 1100 of the computer system of FIG. 6 ends an antenna design process using the OAM mode cancellation in step S105.

As described above, according to the present invention, when the antenna apparatus is designed, an antenna having a low f/D ratio and an excellent reflection characteristic may be designed through the specific OAM mode cancellation.

Figure 5:
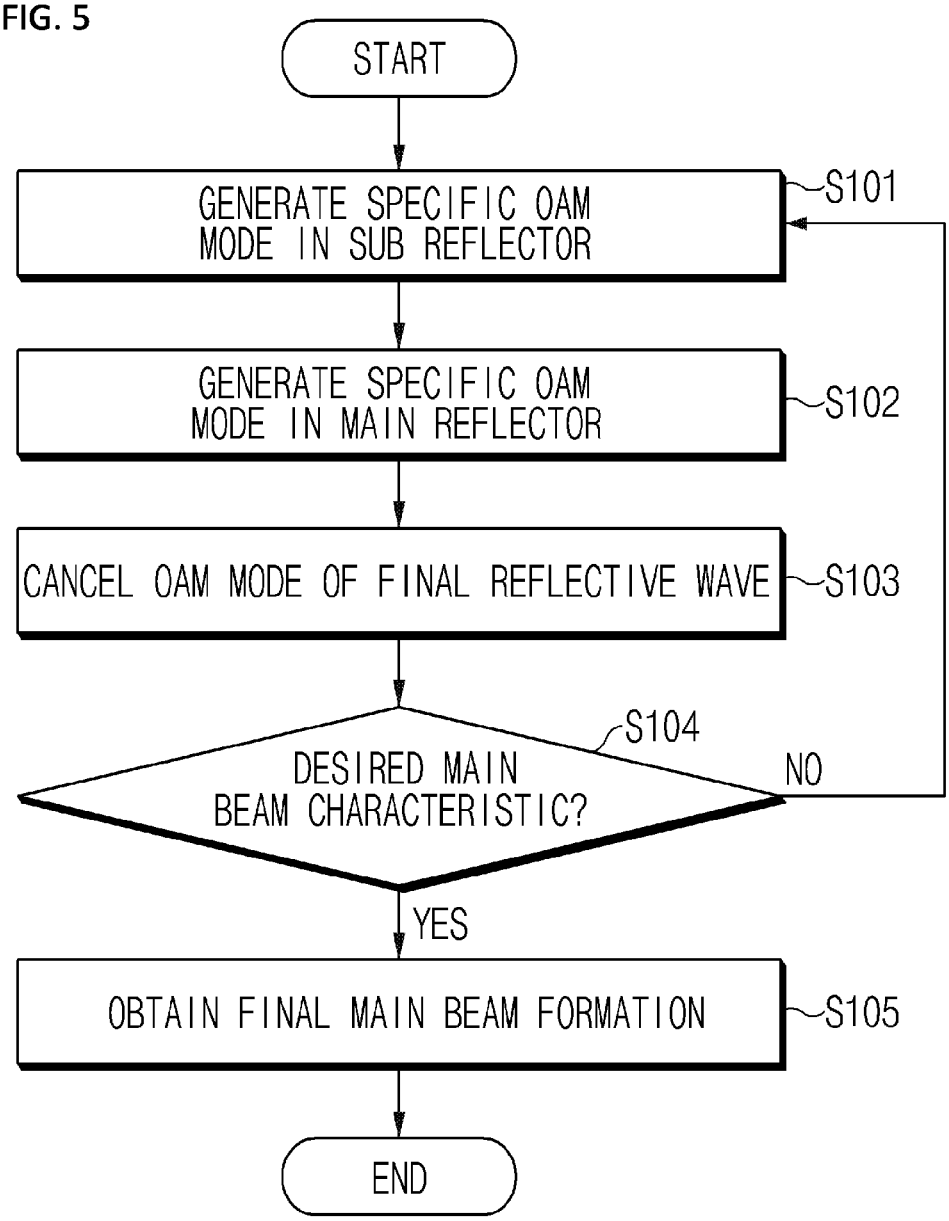
FIG. 5 is a flowchart illustrating an antenna design method for adjusting a desired antenna main beam characteristic using an OAM mode cancellation according to an exemplary embodiment of the present invention.

FIG. 6 is a configuration diagram of a computer system which implements an antenna design technology according to an exemplary embodiment of the present invention described in FIG. 5.

Referring to FIG. 6, a computing system 1000 may include at least one processor 1100, a memory 1300, a user interface input device 1400, a user interface output device 1500, a storage 1600, and a network interface 1700 which are connected to each other through a bus 1200.

The processor 1100 may be a semiconductor device which performs processings on commands which are stored in a central processing unit (CPU), or the memory 1300 and/or the storage 1600. The memory 1300 and the storage 1600 may include various types of volatile or non-volatile storage media. For example, the memory 1300 may include a read only memory (ROM) and a random access memory (RAM).

The method or a step of algorithm which has been described regarding the exemplary embodiments disclosed in the specification may be directly implemented by hardware or a software module which is executed by a processor 1100 or a combination thereof. The software module may be stored in a storage medium (that is, the memory 1300 and/or the storage 1600) such as a RAM, a flash memory, a ROM, an EPROM, an EEPROM, a register, a hard disk, a detachable disk, or a CD-ROM.

An exemplary storage medium is coupled to the processor 1100 and the processor 1100 may read information from the storage medium and write information in the storage medium. As another method, the storage medium may be integrated with the processor 1100. The processor and the storage medium may be stored in an application specific integrated circuit (ASIC). The ASIC may be stored in a user terminal. As another method, the processor and the storage medium may be stored in a user terminal as individual components.

In the specification, unless explicitly described to the contrary, the word "comprise" and variations such as "comprises" or "comprising", will be understood to imply the inclusion of stated elements but not the exclusion of any other elements. In addition, the term "-unit" described in the specification means a unit for processing at least one function and operation and can be implemented by hardware components or software components or combinations thereof.

It will be appreciated that various exemplary embodiments of the present invention have been described herein only for purposes of illustration, and that various modifications, changes, and substitutions may be made by those skilled in the art without departing from the scope and spirit of the present invention.

Accordingly, the exemplary embodiments disclosed herein are intended to not limit but describe the technical spirit of the present invention and the scope of the technical spirit of the present invention is not restricted by the exemplary embodiments. The protection scope of the present invention should be interpreted based on the following appended claims and it should be appreciated that all technical spirits included within a range equivalent thereto are included in the protection scope of the present invention.

What is claimed is:

1. A reflective antenna apparatus, comprising:

a feeder which receives an electromagnetic wave from a transmitter and distributes the electromagnetic wave to the antenna apparatus;

a sub reflector which has a step formed to generate an orbital angular momentum (OAM) mode electromagnetic wave; and a main reflector which has a step formed to generate the same electromagnetic wave as the OAM mode generated by the sub reflector and cancels the OAM mode electromagnetic wave generated by the sub reflector and an OAM mode electromagnetic wave generated by the main reflector to radiate the electromagnetic waves to a far field.

2. The reflective antenna apparatus of claim 1, wherein in the main reflector, the step is formed between a highest portion and a lowest portion of a plate.

3. The reflective antenna apparatus of claim 1, wherein in the sub reflector, the step is formed between a highest portion and a lowest portion of a plate.

4. The reflective antenna apparatus of claim 1, wherein the main reflector has a plurality of steps.

5. The reflective antenna apparatus of claim 1, wherein the sub reflector has a plurality of steps.

6. The reflective antenna apparatus of claim 1, wherein the sub reflector is configured by at least one of a Cassegrain shape, a Gregorian shape, and an axially displaced ellipse (ADE) shape.

7. The reflective antenna apparatus of claim 1, wherein the main reflector determines a characteristic of the reflected OAM mode by the number of steps.

8. A reflective antenna apparatus, comprising:

a feeder which receives an electromagnetic wave from a transmitter and distributes the electromagnetic wave to the antenna apparatus;

a sub reflector in which a reflectarray substrate is formed to generate an orbital angular momentum (OAM) mode electromagnetic wave; and a main reflector in which a reflectarray substrate is formed to generate the same electromagnetic wave as the OAM mode generated by the sub reflector and which cancels the OAM mode electromagnetic wave generated by the sub reflector and an OAM mode electromagnetic wave generated by the main reflector to radiate the electromagnetic waves to a far field.

9. The reflective antenna apparatus of claim 8, wherein on the reflectarray substrate, resonators which change a phase of a reflective wave are arranged.

10. A reflective antenna apparatus, comprising:

a feeder which receives an electromagnetic wave from a transmitter and distributes the electromagnetic wave to the antenna apparatus;

a sub reflector in which a reflectarray substrate is formed to generate an orbital angular momentum (OAM) mode electromagnetic wave; and a main reflector which has a step formed to generate the same electromagnetic wave as the OAM mode generated by the sub reflector and cancels the OAM mode electromagnetic wave generated by the sub reflector and an OAM mode electromagnetic wave generated by the main reflector to radiate the electromagnetic waves to a far field.

11. The reflective antenna apparatus of claim 10, wherein in the main reflector, the step is formed between a highest portion and a lowest portion of a plate.

12. The reflective antenna apparatus of claim 10, wherein the main reflector has a plurality of steps.

13. The reflective antenna apparatus of claim 10, wherein the main reflector determines a characteristic of the reflected OAM mode by the number of steps.

14. A reflective antenna apparatus, comprising:

a feeder which receives an electromagnetic wave from a transmitter and distributes the electromagnetic wave to the antenna apparatus;

a sub reflector which has a step formed to generate an orbital angular momentum (OAM) mode electromagnetic wave; and a main reflector in which a reflectarray substrate is formed to generate the same electromagnetic wave as the OAM mode generated by the sub reflector and which cancels the OAM mode electromagnetic wave generated by the sub reflector and an OAM mode electromagnetic wave generated by the main reflector to radiate the electromagnetic waves to a far field.

15. The reflective antenna apparatus of claim 14, wherein the sub reflector has a plurality of steps.

16. The reflective antenna apparatus of claim 14, wherein the sub reflector is configured by at least one of a Cassegrain shape, a Gregorian shape, and an axially displaced ellipse (ADE) shape.

17. An antenna design method, comprising: reflecting an electromagnetic wave which is radiated from a sub reflector which generates a first OAM mode to a feeder;

reflecting the reflective wave reflected from the sub reflector, by a main reflector which generates a second OAM mode, to output a final reflective wave in which the first OAM mode of the sub reflector and the second OAM mode of the main reflector are cancelled; and confirming a main beam characteristic of the final reflective wave.

18. The method of claim 17, further comprising:

forming the sub reflector and the main reflector to change the first OAM mode and the second OAM mode when the main beam characteristic satisfies a predetermined value and confirming the main beam characteristic of the final reflective wave again.

19. The method of claim 18, wherein when the first OAM mode and the second OAM mode are the same, the main beam characteristic has a high gain characteristic.

20. The method of claim 17, wherein the OAM mode of the final reflective wave is obtained by subtracting the second OAM mode from the first OAM mode.

* * * * *